United States Patent [19]

Yasuhara et al.

[11] 4,295,455

[45] Oct. 20, 1981

[54] EXHAUST GAS RECIRCULATION CONTROL SYSTEM FOR A COMPRESSION-IGNITION INTERNAL COMBUSTION ENGINE

[75] Inventors: Seishi Yasuhara; Jun Teranuma, both of Yokosuka; Motohiro Shinzawa, Zushi; Hiroshi Fujii, Yokohama, all of Japan

[73] Assignee: Nissan Motor Co. Ltd, Yokohama, Japan

[21] Appl. No.: 81,144

[22] Filed: Oct. 2, 1979

[30] Foreign Application Priority Data

Oct. 9, 1978 [JP] Japan ..... 53-124421

[51] Int. Cl.[3] ..... F02M 25/06

[52] U.S. Cl. ..... 123/569

[58] Field of Search ..... 123/569

[56] References Cited

U.S. PATENT DOCUMENTS

| | | | |
|---|---|---|---|
| 3,916,857 | 11/1975 | Naito | 123/569 |
| 4,020,809 | 5/1977 | Kern et al. | 123/569 |
| 4,043,304 | 8/1977 | Stumpp et al. | 123/569 |
| 4,157,081 | 6/1979 | Wake et al. | 123/569 |

*Primary Examiner*—Wendell E. Burns

*Attorney, Agent, or Firm*—Lowe, King, Price & Becker

[57] ABSTRACT

An exhaust gas recirculation control system for a compression-ignition internal combustion engine or diesel engine including an intake throttle valve in an intake passage and an exhaust gas recirculation passage opening downstream of the intake throttle valve, comprises a shut-off valve in the exhaust gas recirculation passage so that the shut-off valve is closed in the proximity of a full load region of the engine.

The system further comprises a link mechanism interlocking the intake throttle valve with the control means of the fuel injection pump, which link mechanism is operative to begin to open the intake throttle valve lagging behind a commencement of an operation of the control means of the fuel injection pump and to completely open the intake throttle valve prior to an arrival of the control means at its full operating position, thereby stabilizing its exhaust gas recirculation control characteristic in low and high load regions, effectively reducing NOx to ensure the stability of the engine in the low load region, reliably preventing black exhaust gases in the high load region and improving the full output of the engine.

9 Claims, 13 Drawing Figures

EXHAUST GAS RECIRCULATION CONTROL SYSTEM FOR A COMPRESSION-IGNITION INTERNAL COMBUSTION ENGINE

BACKGROUND OF THE INVENTION

1. Field of the Invention

The present invention relates to an exhaust gas recirculation control system for a compression-ignition internal combustion engine or Diesel engine.

An exhaust gas recirculation system for reintroducing part of exhaust gas into intake air to suppress a combustion of fuel for reducing NOx exhausted from an engine has been well known.

In recirculating the exhause gas with a spark-ignition engine having an intake throttle valve, the exhaust gas can be recirculated into the intake air to a desired extent by utilizing pressure differences between the exhaust gas and intake negative pressure downstream of the throttle valve. With a compression-ignition or Diesel enging having no intake throttle valve, however, pressure differences between the exhaust gas and intake negative pressure within a low region of the engine are too little to obtain a determined quantity of exhaust gas recirculation, notwithstanding a great quantity of exhaust gas recirculation is required within the low load region of the engine.

It has been proposed to provide in an intake passage a throttle valve responsive to engine loads to communicate an exhaust gas recirculation with the downstream of the throttle valve in order to control the quantity of the exhaust gas recirculation depending upon the intake negative pressure.

According to this conventional control system, the quantity of exhaust gas recirculation decreases inversely proportionally to the increase of the load of the engine as shown in FIG. 1. It is therefore theoretically successful in decreasing NOx, keeping the high engine performance and preventing "smoke" which is a black exhaust gas containing unburned gases.

In embodying this control system, however, an interlocking mechanism for the throttle valve and a fuel injection control lever unavoidably includes therein plays or clearances which make difficult the proper control of the exhaust gas recirculation flow in an extremely low load region when the throttle valve is almost closed, and a slight deviation of the exhaust gas recirculation flow remarkably increases the smoke in the high load region near the "smoke" limit which means a limit that the exhaust gas containing unburned gases begins to appear black. Accordingly, as the dispersion in dimensional tolerance of parts becomes very important, it is almost impossible to embody the above described exhaust gas recirculation system of the prior art without paying a particular precaution for a quality control of the parts.

SUMMARY OF THE INVENTION

It is therefore an objectof the invention to provide an improved exhaust gas recirculation control system for a compression-ignition internal combustion engine.

It is another object of the invention to provide an exhaust gas recirculation control system for a compression-ignition internal combustion engine comprising means for certainly shutting off before the smoke limit the exhaust gas recirculation flow whose controlled quantity decreases as the load increases, and maintaining constant openings of a throttle valve near the completely closed and opened regions thereof so as to deviate from the proportional control to the angle of a pump control lever moved by an accelerator pedal controlling the quantity of fuel injection, stabilizing the exhaust gas recirculation control characteristic in the low and high load regions, effectively reducing NOx to ensure the stability of the engine in the low load region, reliably preventing "smoke" in the high load region and improving the full output of the engine.

In order to achieve these and other objects of the invention, the exhaust gas recirculation control system for a compression-ignition internal combustion engine including an intake throttle valve in an intake passage and having an exhaust gas recirculation passage opening downstream of said intake throttle valve, according to the invention said system comprises a shut-off valve in said exhaust gas recirculation passage interlocked with control means of a fuel injection pump so that said shut-off valve is closed in the proximity of a full load region of the engine.

In an another aspect, the exhaust gas recirculation control system further comprises a link mechanism for interlocking said intake throttle valve with said control means of said fuel injection pump, which link mechanism is operative to begin to open said intake throttle valve lagging behind a commencement of an operation of said control means of said fuel injection pump and to completely open said intake throttle valve prior to an arrival of said control means at its full operating position.

In order that the invention may be more clearly understood, preferred embodiments will be described, by way of example, with reference to the accompanying drawings.

DETAILED DESCRIPTION OF THE PREFERRED EMBODIMENT

The control system according to the invention is so constructed as to realize characteristic curves shown in FIGS. 2*a*–2*c* which will be explained in detailed explanation of the embodiments shown in FIGS. 3–10.

Figure 3:
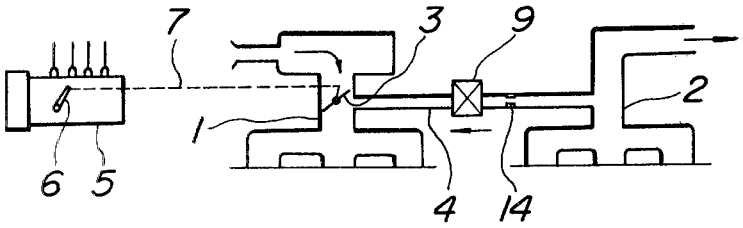
FIG. 3 is a diagrammatic sectional view of the system according to the invention.
Figure 4A:
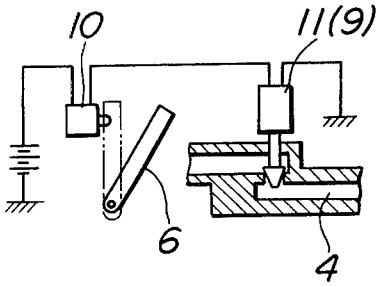
FIGS. 4*a* and 4*b* are sectional views of embodiments of shut-off valves for use in the system according to the invention.
Figure 4B:
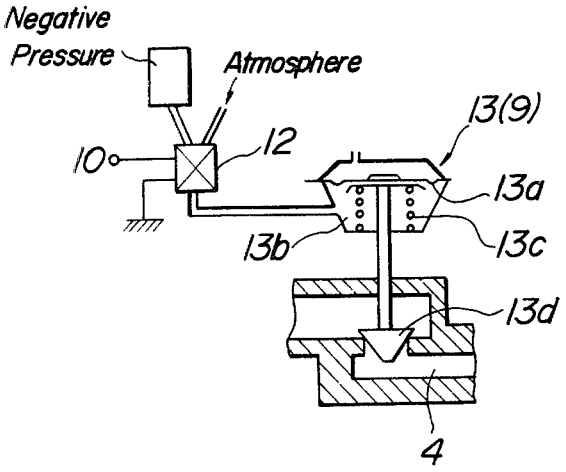

Referring to FIG. 3, between an intake passage 1 and an exhaust passage 2 is connected an exhaust gas recirculation passage 4 downstream of a throttle valve 3 in the intake passage 1. The throttle valve 3 is interlocked through a link mechanism 7 later described to a control lever 6 for a fuel injection pump 5 and opens to an extent in principle proportional to a quantity of injected fuel.

At the midway of the exhaust gas recirculation passage 4 is provided a shut-off valve 9 for shutting off the recirculation passage 4 in a high load region. As show in FIGS. 4*a* and 4*b*, the shut-off valve 9 comprises a detection switch 10 adapted to be operated when the control lever 6 assumes a position corresponding to a determined high load (angle $\alpha_3$ of the control lever in FIG. 2) and an electromagnetic valve 11 for closing the recirculation passage 4 in response to a signal from the detection switch 10 or instead thereof a diaphragm valve 13 adapted to be changed over in response to negative and atmospheric pressures by means of an electromagnetic change-over valve 12 with the aid of signals from the detection switch 10.

The diaphragm valve 13 comprises a pressure sensing chamber 13*b* defined by a diaphragm 13*a* into which the negative and atmospheric pressures are selectively introduced to open and close a valve body 13*d* against a return spring 13*c*. The negative pressure is supplied from a vacuum pump. Instead of the negative pressure, the positive pressure for an air brake may be used. In general, the diaphragm valve 13 is closed by the action of the negative pressure (or positive pressure) in response to signals from the detection switch 10 in the high load region. The diaphragm may be normally maintained opened and closed by the action of the return spring 13*c* in the high load region. An orifice 14 is provided in the exhaust gas recirculation passage 4 upstream of the shut-off valve 9 for controlling the exhaust gas recirculation flow.

Figure 5:
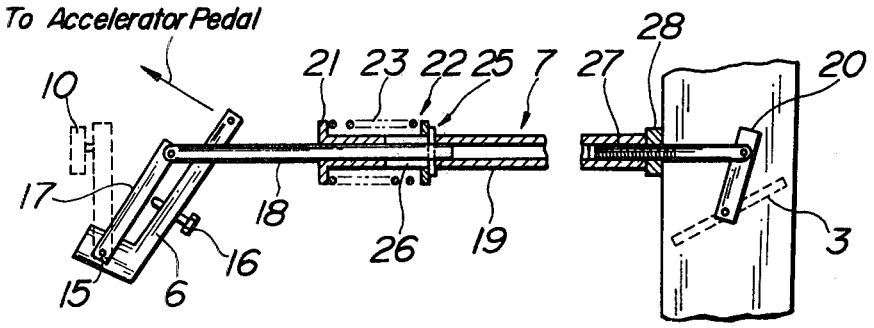
FIG. 5 is a partial sectional view of a link mechanism for use in the system according to the invention.
Figure 6:
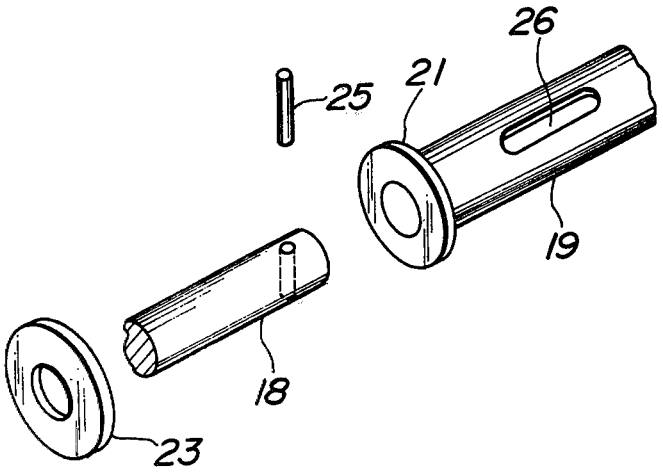
FIG. 6 is a perspective view of the link mechanism shown in FIG. 5.

Referring to FIGS. 5 and 6, the control lever 6 interconnected to the throttle valve 3 through the link mechanism 7 has a lower end fixed to a fuel injection pump shaft 15 of the fuel injection pump 5 for controlling the quantity of the fuel injection with aid of an accelerator pedal (not shown). The control lever 6 is engagable with a pump lever 17 through an adjustment screw 16 provided on the midway of the control lever 6.

The pump lever 17 is pivotally supported on the pump shaft 15 and has one end to which is connected a rod 18. To the rod 18 is axially relatively movably connected a hollow rod 19 to which is in turn connected a throttle valve lever 20 of the throttle valve 3. The hollow rod 19 is provided with a spring seat 21 fixed to its one end, an axially slidable spring seat 22 slidably fitted on the hollow rod 19, a coil spring 23 interposed between the seats, and a pin 25 fixed to and passing through one end of the rod 18 for determining the position of the slidable spring seat 22.

In other words, the end of the rod 18 is slidably inserted into the hollow rod 19 and the pin 25 is then planted through elongated apertures 26 of the hollow rod 19 in the end of the rod 18 such that ends of the pin 25 extend beyond the outer surface of the hollow rod 19. A force of the coil spring 23 urges the the spring seat 22 to the pin 25 abutting against the ends of the elongated apertures 26, so that the rod 18 and the hollow rod 19 normally form an integral body without any relative movements in axial directions.

With the other end of the hollow rod 19 is threadedly engaged one end of an adjustment rod 27 which is fixed relative thereto by means of a rock nut 28 and has the other end is connected to the throttle valve lever 20.

With this arrangement, upon treading an accelerator pedal (not shown), the control lever 6 is rotated in a counter clockwise direction as viewed in FIG. 5. The adjustment screw 16 is previously adjusted so as not to abut against the pump lever 17 before the angle of the control lever 6 becomes $\alpha_1$ shown in FIG. 2, during which the quantity of injected fuel increases while the throttle valve 3 is kept at an opened degree $\theta$ (FIG. 2*c*) which is near a complete closing, whereby the quantity of exhaust gas recirculation is maintained at a constant value $Q_1$ until the angle of the lever becomes $\alpha_1$.

Then the pump lever 17 begins to rotate in the counter clockwise direction together with the control lever 6, so that the rod 18 is pulled to the left as viewed in FIG. 5 and hence the hollow rod 19 begins to move in unison in the same direction by means of the force of the coil spring 23 through the spring seat 22 engaging the pin 25. As the result, the throttle valve 3 connected to the throttle valve lever 20 begins to open to increase the quantity of intake air flow in proportion to the angular movement of the throttle valve 3.

During this time, the angle of the control lever and opening of the throttle valve are linearly proportional to each other, and when the angle of the control lever becomes $\alpha_2$ in the high load region near the smoke limit, the throttle valve 3 is fully opened.

Downstream of the throttle valve 3 an intake negative pressure prevails which has a characteristic in that the less the opening of the throttle valve, the higher becomes the absolute value of the negative pressure. Accordingly, the quantity of exhaust gas recirculation flowing into the intake air depending upon the pressure difference between the exhaust gas pressure and intake negative pressure decreases from the maximum value $\alpha_1$ progressively with increase of the opening of the throttle valve to the minumum value $Q_2$ at the angle $\alpha_2$ of the control lever (full opening of the throttle valve), thereby preventing the quantity of the exhaust gas recirculation from varying in the proximity of the smoke limit.

When the throttle valve 3 is fully opened, the throttle valve lever 20 is stopped by an action of a stopper (not shown) and hence the hollow rod 19 cannot move further toward the left as viewed in FIG. 5.

When the control lever 6 is further moved, the rod 18 moves to the left as viewed in FIG. 4 compressing the coil spring 23 with the aid of the pin 25 and spring seat 22, while the quantity of the exhaust gas recirculation is maintained at the constant valve $Q_2$ but the quantity of the injected fuel increases further.

When the angle of the control lever becomes $\alpha_3$ immediately before the smoke limit, the shut-off valve 9 fully closes the exhaust gas recirculation passage 4 in response to an operation of the detection switch 10 to shut off the exhaust gas recirculation flow completely.

Therefore, the quantity of fuel flow increases without any exhaust gas recirculation until the angle of the control lever is maximum, thereby ensuring the full output of the engine.

Figure 1:
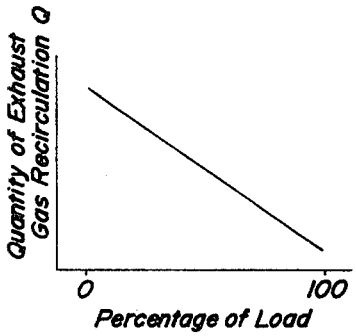
FIG. 1 PRIOR ART
FIG. 1 is a graph illustrating a characteristic relation between quantities of exhaust gas recirculation and angles of a control lever of a fuel injection pump (percentage of load) of the prior art system as described above.
Figure 2A:
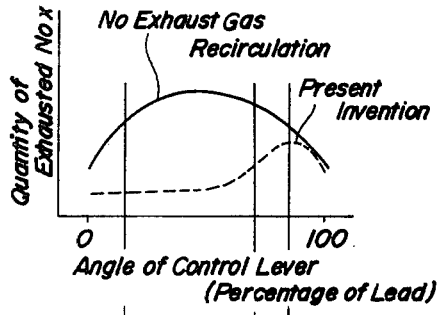
FIGS. 2*a*–2*c* are graphs showing characteristic curves of the system according to the invention.
Figure 2B:
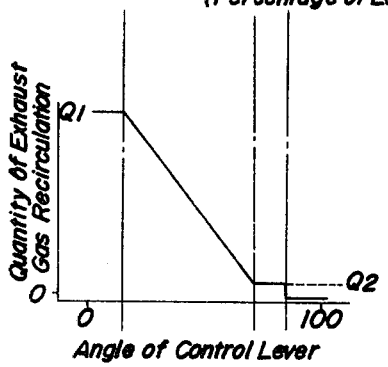
Figure 2C:
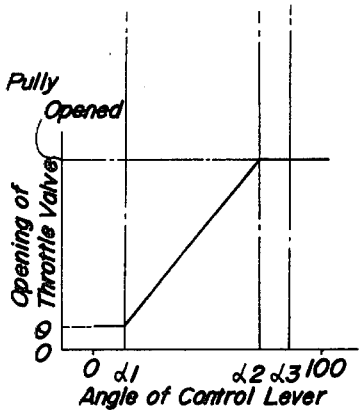

As a result of controlling the quanity of exhaust gas recirculation in a manner as shown in FIGS. 2*a*–2*c*, the generation of NOx can be effectively reduced without adversely affecting the operative performance of the engine in low and medium load regions within which Diesel engines for automobiles are in general the most frequently used.

Figure 7:
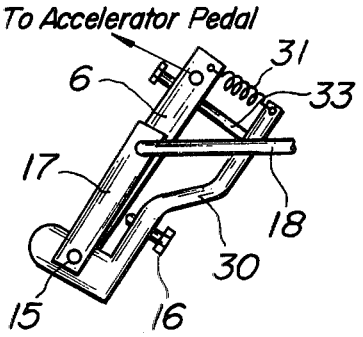
FIGS. 7–10 are elevations illustrating other embodiments of the link mechanism used in the system according to the invention, respectively.
Figure 8:
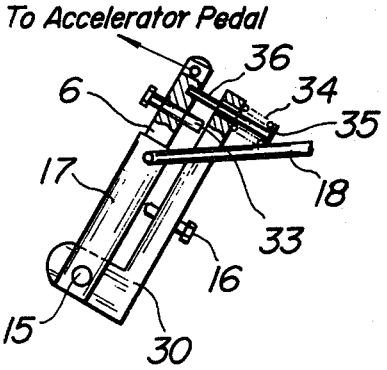

FIGS. 7 and 8 illustrate other embodiments of the link mechanism. In the embodiment shown in FIG. 7, an intermediate lever 30 is pivotally supported on a pump shaft 15 and connected to a control lever 6 by means of a tension spring 31 and is provided with an adjustment screw 16 adapted to engage a pump lever 17. A stopper 33 is provided in the intermediate lever 30 or control lever 6 for setting the force of the spring 31.

With this arrangement, when the control lever 6 is moved in connection with an accelerator pedal, the intermediate lever 30 moves together with the control lever 6 and the pump lever 17 is then moved in the same direction after abutting of the adjustment screw 16 against the pump lever 17 to open a throttle valve 3. When the throttle valve 3 is fully opened, the control lever 6 is further moved tensioning or elongating the tension spring 31 while the pump lever 17 and intermediate lever 30 remain in their positions. In this case, a rod 18 connected to the pump lever 17 is directly interconnected to a throttle valve lever 20.

In the embodiment shown in FIG. 8, a compression spring 34 is used in substitution for the tension spring 31 in FIG. 7. A rod 36 having a spring seat 35 is slidably inserted in an intermediate lever 30 and has one end (threadedly) fixed to a control lever 6. The compression spring 34 resiliently urges the intermediate lever 30 against a stopper 33. After the throttle valve is fully opened, the angle of the control lever 6 relative to the intermediate lever 30 increases compressing the compression spring 34.

Figure 9:
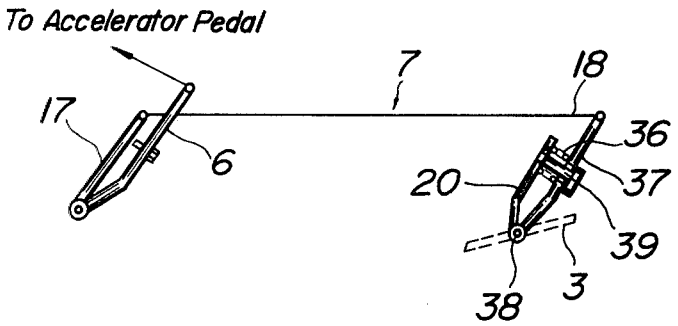
Figure 10:
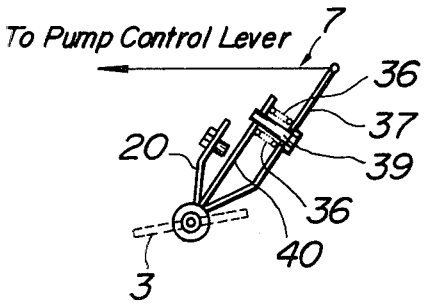

FIGS. 9 and 10 illustrate further embodiments including the lagging mechanism of link mechanism 7 arranged on the side of a throttle valve 3. The "lagging" means that the opening of the throttle valve lags behind the angular movement of the control lever after the full opening of the throttle valve. In the embodiment shown in FIG. 9, a free lever 37 is pivotally supported on a throttle valve shaft 38 and resiliently urges a throttle valve lever 20 through a compression spring 36. The other end of the free lever 37 is connected a rod 18 which is in turn connected to a pump lever 17. An adjustment screw 39 adjusts the maximum distance between the throttle valve lever 20 and free lever 37 urges away from each other by means of the compression spring 36. After the throttle valve is fully opened, the free lever 37, which has moved with the throttle valve lever 20 in unison, approaches the lever 20 compressing the compression spring 36 to permit the angle of the control lever 6 to increase after full opening of the throttle valve 3.

In the embodiment shown in FIG. 10, in addition to a free lever 37 an intermediate lever 40 is pivotally supported on a throttle valve shaft 38. The free lever 37 and intermediate lever 40 are connected to each other by means of a compression spring 36 and an adjustment screw 39. After the free lever 37 has been rotated a determined angle together with the control lever 6, the intermediate lever 40 abuts against a throttle valve lever 20 through an adjustment screw 41.

As can be seen from the above description, according to the invention, the accuracy in controlling the quantity of exhaust gas recirculation within very little and very large throttle valve opening ranges without requiring any high dimensional accuracy of parts of the link mechanism, thereby maintaining an engine operative performance at good condition and effectively minimizing NOx.

According to the invention, moreover, the exhaust gas recirculation is certainly stopped within the high load region near the smoke limit, thereby restraining the smoke, preventing rapid increases of HC and CO and improving the full output of an engine.

It is further understood by those skilled in the art that the foregoing description is preferred embodiments of the disclosed system and that various changes and modifications may be made in the invention without departing from the spirit and scope thereof.

What is claimed is:

1. An exhaust gas recirculation control system for a compression-ignition internal combustion engine having an intake throttle valve in an intake passage and an exhaust gas recirculation passage opening located downstream of the intake throttle valve, comprising (a) a shutoff valve in the exhaust gas recirculation passage;

(b) control means of a fuel injection pump, said control means interconnected with the shutoff valve, said shutoff valve being closed in proximity to a full load region of the engine; and (c) a link mechanism interconnecting the intake throttle valve and control means, said link mechanism including delay means for initiating opening of the intake throttle valve at a time following commencement of operation of the control means of the fuel injection pump and means for completely opening said intake throttle valve before said control means reaches a full operating position.

2. An exhaust gas recirculation control system according to claim 1, including an electromagnetic changeover valve and a fuel injection pump control lever position detecting switch wherein said shutoff valve is a pressure-responsive valve operable in response to a negative pressure supplied through said electromagnetic changeover valve in turn operable in response to signals from said switch detecting a position of said fuel injection pump control lever.

3. An exhaust gas recirculation control system according to claim 1, including an electromagnetic changeover valve and a fuel injection pump control lever position detecting switch wherein said shutoff valve is a pressure-responsive valve operable in response to a positive pressure supplied through said electromagnetic changeover valve in turn operable in response to signals from said switch detecting a position of said fuel injection pump control lever.

4. An exhaust gas recirculation control system according to claim 1, including an injection pump control lever and an intake throttle valve lever, wherein said link mechanism interconnects said fuel injection pump control lever and said intake throttle valve lever.

5. An exhaust gas recirculation control system as set forth in claim 4, wherein said link mechanism includes spring means causing a lagging inoperative phase between the interconnected fuel injection pump control lever and intake throttle valve lever in response to an operative force in excess of a predetermined value acting on the mechanism.

6. An exhaust gas recirculation control system according to claim 5, wherein said link mechanism includes a hollow rod slidably receiving a rod member therein, and said spring means includes a compression spring interconnecting the rod member and hollow rod in a manner enabling said rod to move in unison and operable to permit relative movement therebetween when said operative force acts on the link mechanism.

7. An exhaust gas recirculation control system as set forth in claim 5, wherein said link mechanism comprises an intermediate lever pivotally supported on a pump shaft, and said spring means connects said fuel injection pump control lever and said intermediate lever so as to move in unison but to permit a relative movement therebetween when said operative force acts on the mechanism.

8. An exhaust gas recirculation control system as set forth in claim 5, wherein a free lever is pivotally supported on a throttle valve shaft, and said spring means connects said free lever and said throttle valve lever so as to move in unison but to permit a relative movement therebetween when said operative force acts on the mechanism.

9. An exhaust gas recirculation control system as set forth in claim 5, wherein a free lever and an intermediate lever are pivotally supported on a throttle valve shaft, and said spring means connects said free lever and said intermediate lever so a to move in unison and after these levers have been rotated a determined angle, to abut against said throttle valve lever but to permit a relative movement between said free lever and said intermediate lever when said operative force acts on the mechanism.

* * * * *